US012774672B2

(12) United States Patent
Silva et al.

(10) Patent No.: US 12,774,672 B2
(45) Date of Patent: Oct. 27, 2026

(54) EXHAUST UNITS FOR ROAD VEHICLES

(71) Applicant: FERRARI S.P.A., Modena (IT)

(72) Inventors: Mauro Silva, Modena (IT); Marzio Maresi, Modena (IT)

(73) Assignee: FERRARI S.P.A., Modena (IT)

( * ) Notice: Subject to any disclaimer, the term of this patent is extended or adjusted under 35 U.S.C. 154(b) by 0 days.

(21) Appl. No.: 19/244,821

(22) Filed: Jun. 20, 2025

(65) Prior Publication Data

US 2025/0389217 A1 Dec. 25, 2025

(30) Foreign Application Priority Data

Jun. 24, 2024 (IT) ..... 102024000014506

(51) Int. Cl.
*F01N 13/10* (2010.01)
*F01N 13/08* (2010.01)

(52) U.S. Cl.
CPC ..... *F01N 13/10* (2013.01); *F01N 13/082* (2013.01); *F01N 13/087* (2013.01); *F01N 2240/36* (2013.01); *F01N 2470/14* (2013.01)

(58) Field of Classification Search
CPC ..... F01N 13/08; F01N 13/082; F01N 13/087; F01N 13/10; F01N 13/107; F01N 2470/14; F01N 1/161; F01N 1/163; F01N 1/165; F01N 1/166; F01N 1/168; F01N 2240/36
See application file for complete search history.

(56) References Cited

U.S. PATENT DOCUMENTS

| | | | | |
|---|---|---|---|---|
| 6,457,551 | B1 | 10/2002 | Chang | |
| 2018/0252131 | A1* | 9/2018 | Akrapovic | F01N 3/00 |
| 2019/0337377 | A1* | 11/2019 | Herwat | B60K 13/04 |
| 2022/0205377 | A1* | 6/2022 | Ballatore | F01N 13/082 |

FOREIGN PATENT DOCUMENTS

| | | | |
|---|---|---|---|
| EP | 4023862 | B1 | 2/2024 |
| KR | 20000056951 | A1 | 9/2000 |

OTHER PUBLICATIONS

Italian Search Report and Written Opinion in IT Application No. 202400014506, mailed Oct. 30, 2024, an English translation attached hereto (7 pages).

* cited by examiner

*Primary Examiner* — Loren C Edwards
(74) *Attorney, Agent, or Firm* — Leason Ellis LLP

(57) ABSTRACT

An exhaust unit for road vehicles has two exhaust ducts provided with respective exhaust mouths, which are arranged side by side, and have respective outlet cross sections identical to one another; each exhaust mouth being divided by a relative separating partition into two outlet channels, which are one connected with the relative exhaust duct and the other separated from the relative exhaust duct, and have respective exhaust cross sections equal to the exhaust cross sections of the corresponding outlet channels (of the other exhaust mouth).

5 Claims, 4 Drawing Sheets

EXHAUST UNITS FOR ROAD VEHICLES

CROSS-REFERENCE TO RELATED APPLICATIONS

This patent application claims priority from Italian patent application no. 102024000014506 filed on 24 Jun. 2024, the contents of which are incorporated herein by reference.

TECHNICAL FIELD

The present invention relates to an exhaust unit for road vehicles.

In particular, the present invention relates to an exhaust unit for road vehicles of the type comprising a first exhaust duct and a second exhaust duct provided with a first exhaust mouth and a second exhaust mouth, respectively, which are arranged side by side; a supply manifold to supply an exhaust gas flow to said first and second exhaust ducts; and a valve device to selectively control the supply of the exhaust gas flow from the supply manifold to said first and second exhaust ducts.

CONTEXT

Generally, to meet current regulations in terms of exhaust unit noise:

- the first exhaust mouth has a cylindrical shape and is connected with the first exhaust duct; and
- the second exhaust mouth comprises a cylindrical-shaped outer pipe, which has an exhaust cross section identical to an exhaust cross section of the first exhaust mouth, and is separated from the second exhaust duct, and a cylindrical-shaped inner pipe, which is mounted inside the outer pipe, and is connected with the second exhaust duct.

Since the outer pipe protrudes axially from the inner pipe, the known exhaust units of the type described above have some drawbacks mainly deriving from the fact that the exhaust gas flow exiting from the inner pipe laps, and interacts with, the outer pipe generating an undesired acoustic effect, in this case a blow.

SUMMARY

It is an object of the present invention to provide an exhaust unit for road vehicles that is free from the drawbacks set out above and that is simple and economical to realise.

According to the present invention there is provided an exhaust unit for road vehicles as claimed in the appended claims.

BRIEF DESCRIPTION OF THE DRAWINGS

The present invention will now be described with reference to the attached drawings, which illustrate a non-limiting embodiment thereof, wherein.

DESCRIPTION OF EMBODIMENTS

Figure 1:
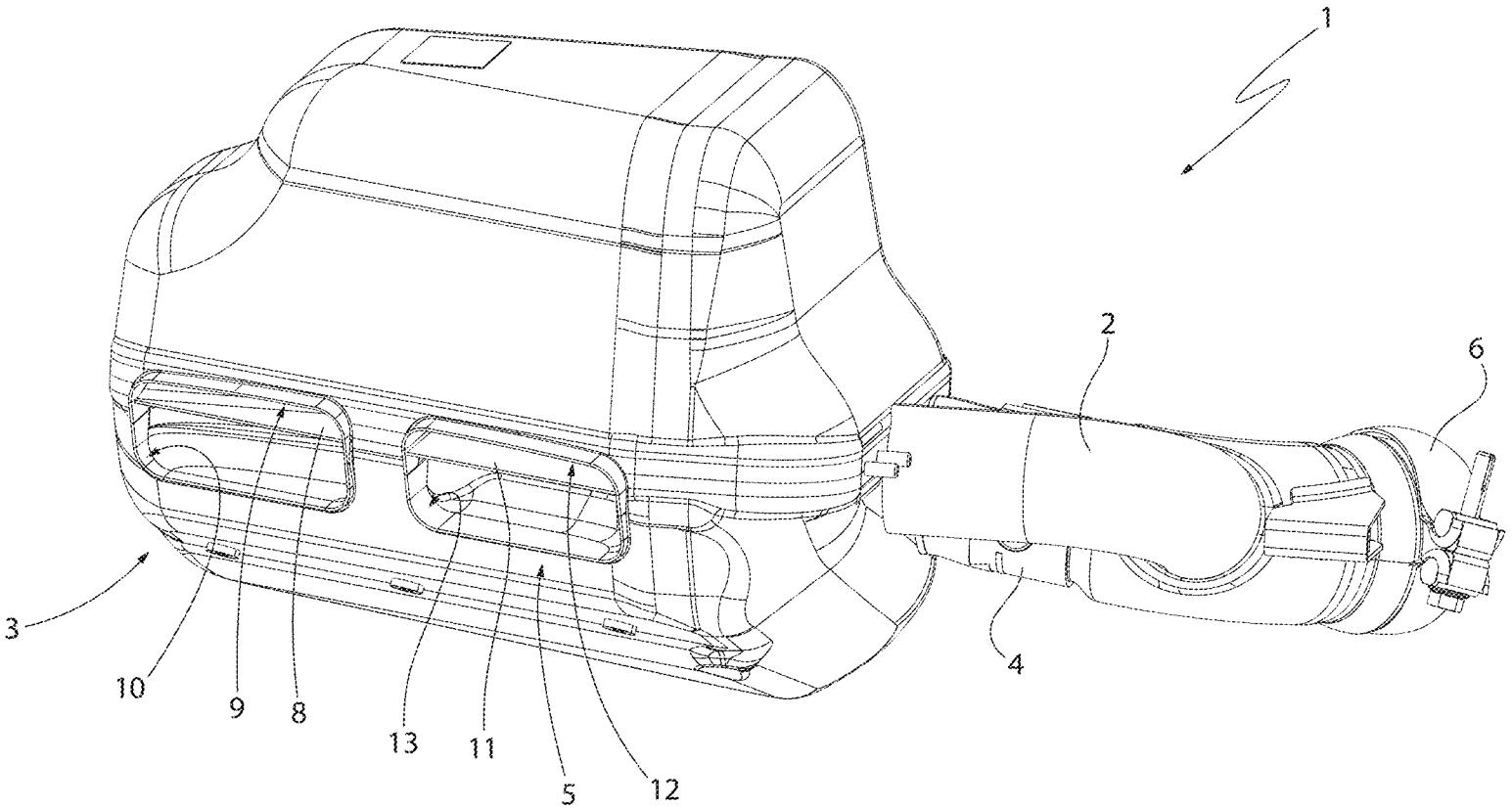
FIGS. 1 and 2 are two schematic perspective views, with parts removed for the sake of clarity, of a preferred embodiment of the exhaust unit of the present invention.
Figure 2:
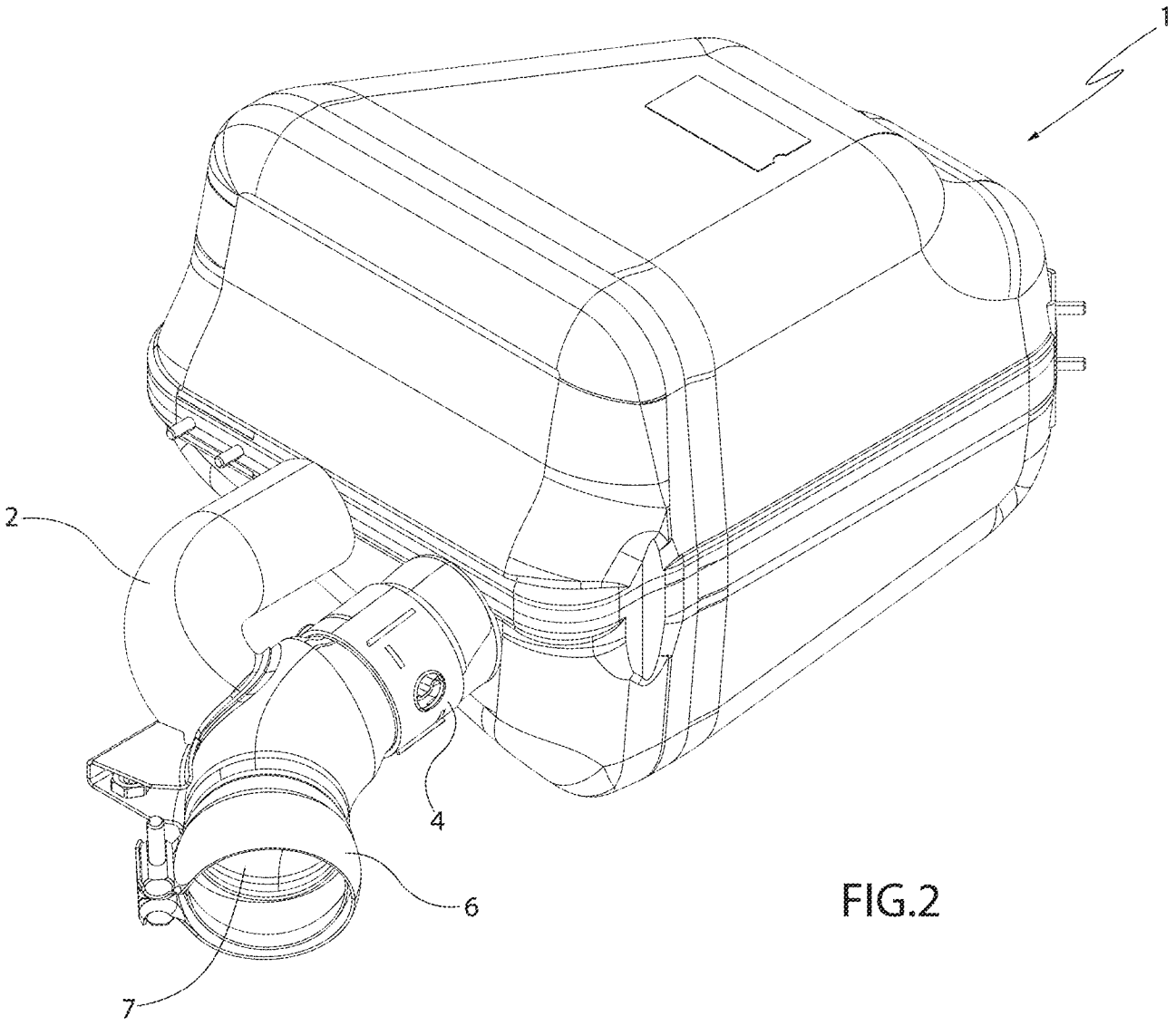
Figure 3:
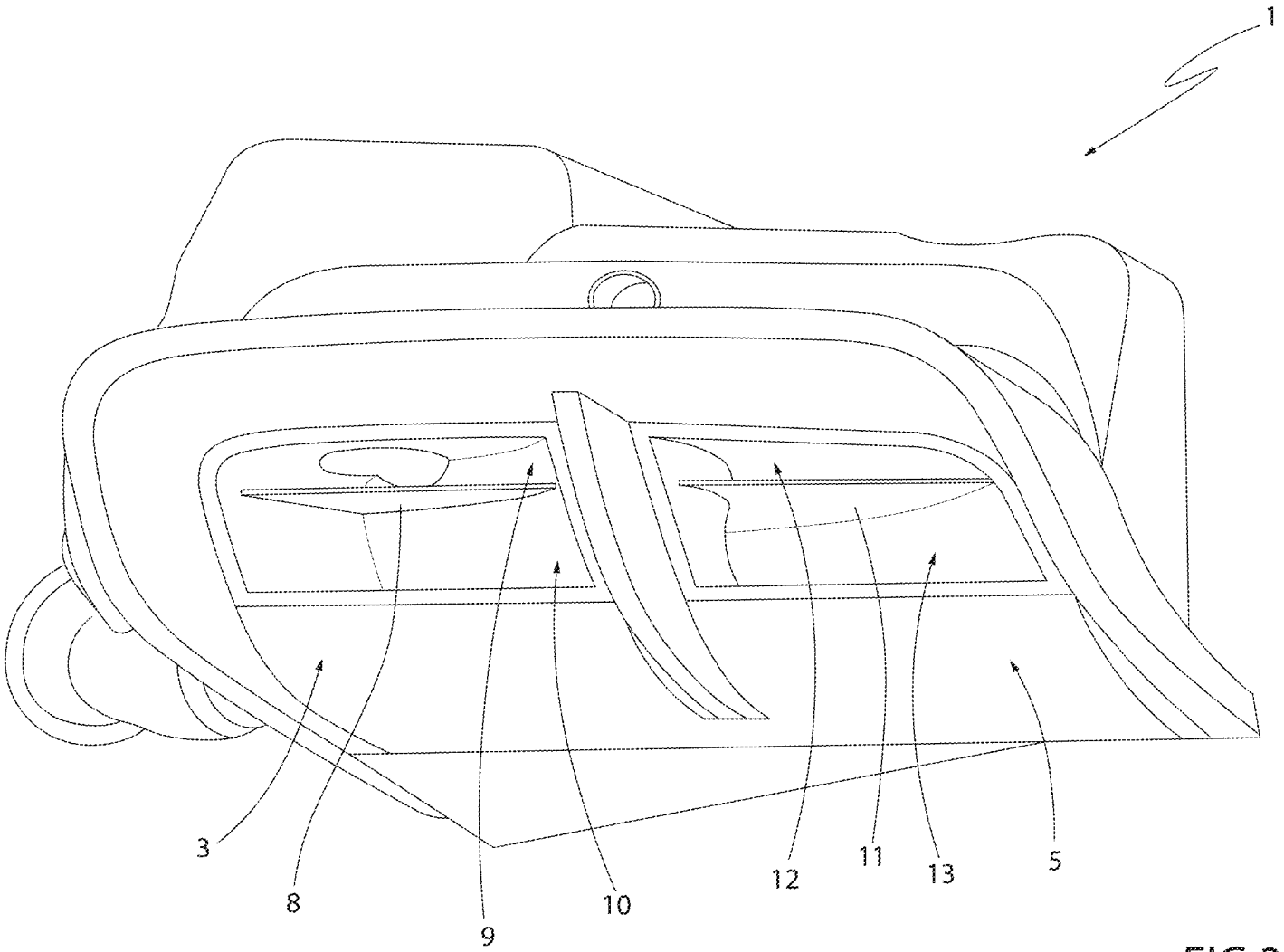
FIG. 3 is a schematic perspective view, with parts removed for the sake of clarity, of a detail of the exhaust unit of FIGS. 1 and 2.
Figure 4:
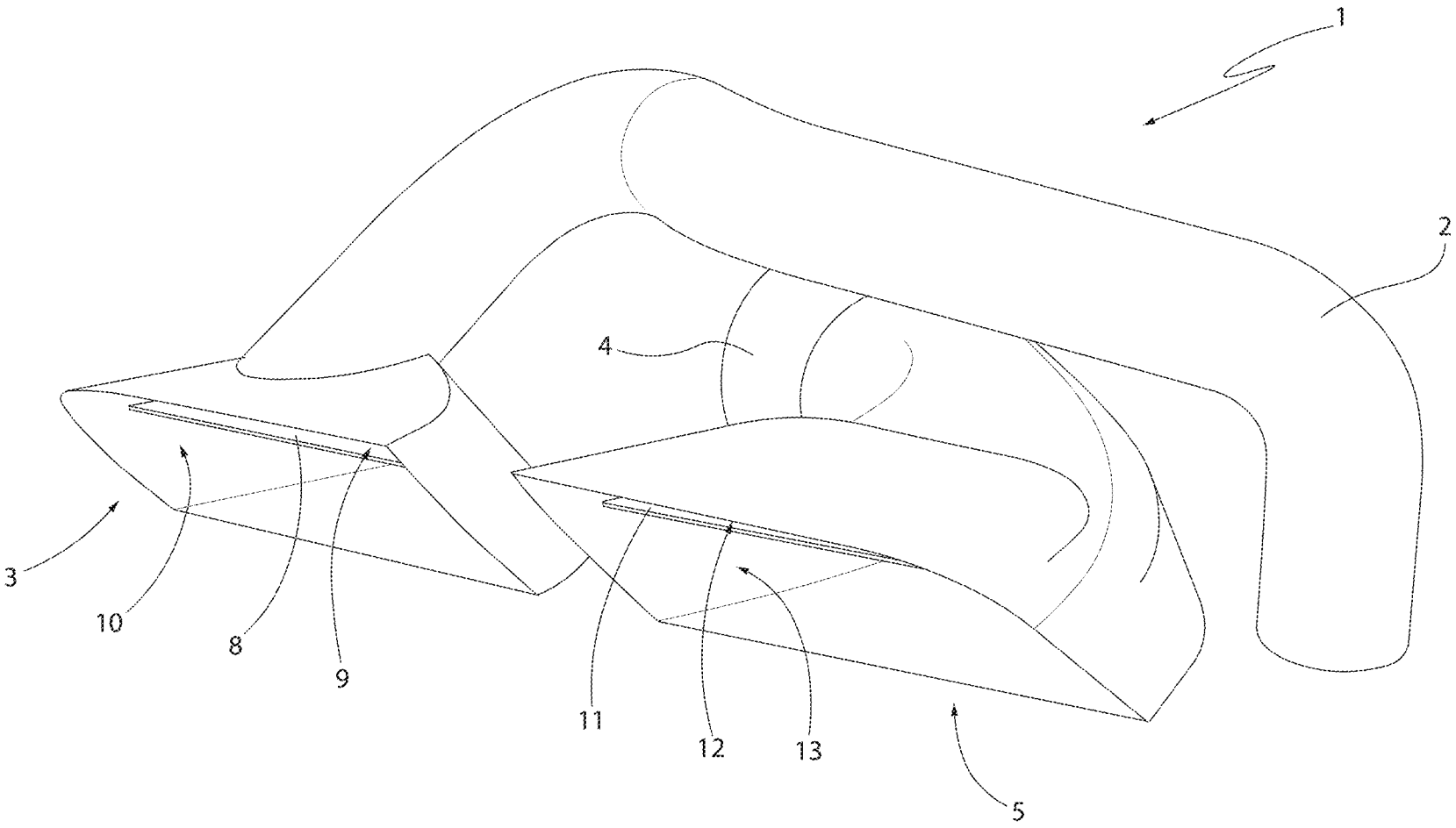
FIG. 4 is a schematic perspective view, with parts removed for the sake of clarity, of a detail of FIG. 3.

With reference to FIGS. 1 to 4, 1 denotes, as a whole, an exhaust unit for road vehicles.

The exhaust unit 1 comprises a first exhaust duct 2 provided with a first exhaust mouth 3; a second exhaust duct 4 provided with a second exhaust mouth 5; and a supply manifold 6 to supply an exhaust gas flow to the ducts 2 and 4.

The exhaust unit 1 is further provided with a valve device 7 to selectively control the supply of the exhaust gas flow from the manifold 6 to the ducts 2 and 4.

The mouths 3 and 5 are side by side, and have respective outlet cross sections identical to one another.

The mouth 3 is provided with a separating partition 8 which is arranged and configured to divide the mouth 3 into a first outlet channel 9 connected with the duct 2 and a second blind outlet channel 10 separated from the duct 2 itself.

The mouth 5 is provided with a separating partition 11 arranged and configured so as to divide the mouth 5 into a first blind outlet channel 12 separated from the duct 4 and a second outlet channel 13 connected with the duct 4 itself.

The channels 9 and 12 are side by side, are arranged above the relative channels 10 and, respectively, 13, and have respective exhaust cross sections identical to one another.

The channels 10 and 13 are side by side, are arranged below the relative channels 9 and, respectively, 12, and have respective exhaust cross sections identical to one another.

The exhaust cross section of each channel 9, 12 is smaller than the exhaust cross section of the corresponding channel 10, 13.

The exhaust unit 1 has some advantages mainly deriving from the fact that:

- the channel 9 meets the requirements imposed by current legislation in terms of noise and the channel 13 meets the acoustic and performance requirements required by the user; and
- the presence of the separating partitions 8, 11 allows the exhaust gas flows exiting from the channels 9 and 13 not to interact with the channels 10 and 12 and, therefore, not to generate unwanted acoustic effects, in this case blows.

With regard to the above, it should be noted that the mode of performance allowed by the configuration of the exhaust mouths 3, 5 is intended to allow operation in areas where the laws on noise are not in conflict.

The invention claimed is:

1. An exhaust unit for road vehicles, the exhaust unit comprising:

- a first exhaust duct and a second exhaust duct provided with a first exhaust mouth and a second exhaust mouth, respectively, the first exhaust mouth and the second exhaust mouth are side by side, and have respective outlet cross sections identical to one another;
- a supply manifold to supply an exhaust gas flow to said first exhaust duct and said second exhaust duct;
- a first separating partition, which is configured and arranged to divide the first exhaust mouth into a first outlet channel connected with the first exhaust duct and a second blind outlet channel separated from the first exhaust duct;
- a second separating partition configured and arranged to divide the second exhaust mouth into a first blind outlet channel separated from the second exhaust duct and a second outlet channel connected with the second exhaust duct;
- said first outlet channel of the first exhaust mouth and said first blind outlet channel of the second exhaust mouth being side by side and having respective first exhaust cross sections identical to one another; and said second outlet channel of the second exhaust mouth and said second blind outlet channel of the first exhaust mouth being side by side and having respective second exhaust cross sections identical to one another.

2. The exhaust unit according to claim 1, wherein the first exhaust cross section of each of the first outlet channels is smaller than the second exhaust cross section of the corresponding second outlet channel.

3. The exhaust unit according to claim 1, wherein the outlet channels of each of the exhaust mouths overlap one another.

4. The exhaust unit according to claim 1, wherein the first outlet channel of the first exhaust mouth is arranged above the second outlet channel of the first exhaust mouth and the first outlet channel of the second exhaust mouth is arranged above the second outlet channel of the second exhaust mouth.

5. The exhaust unit according to claim 1, further comprising a valve device to selectively control the supply of the exhaust gas flow from the supply manifold to said first exhaust duct and said second exhaust duct.

* * * * *